United States Patent [19]

Yoneda et al.

[11] 4,113,066

[45] Sep. 12, 1978

[54] ELEVATOR CONTROL APPARATUS HAVING A NOVEL HALL CALL ALLOTTING DEVICE

[75] Inventors: Kenji Yoneda; Masao Nakazato; Takeo Yuminaka, all of Katsuta, Japan

[73] Assignee: Hitachi, Ltd., Japan

[21] Appl. No.: 702,145

[22] Filed: Jul. 2, 1976

[30] Foreign Application Priority Data

Jul. 2, 1975 [JP] Japan ..... 50-80814

[51] Int. Cl.[2] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 3,519,106 | 7/1970 | Kirsch | 187/29 |
| 3,739,880 | 6/1973 | Robaszkiewicz | 187/29 |
| 3,741,347 | 6/1973 | Kirsch | 187/29 |
| 3,750,850 | 8/1973 | Winkler et al. | 187/29 |

*Primary Examiner*—Robert K. Schaefer
*Assistant Examiner*—W. E. Duncanson, Jr.
*Attorney, Agent, or Firm*—Craig & Antonelli

[57] ABSTRACT

A control circuit for allotting hall calls to elevator cars in an elevator car system, having a generator for generating a scanning signal consisting of scanning pulses. A hall call detector receives the scanning signal and generates a signal indicating the floor at which a hall call occurs. Elevator car detectors are provided, each of which receives the scanning signal and generates a signal indicating the position of the corresponding elevator cars. A memory circuit determines the serving areas of the respective elevator cars according to the signals from the elevator car detectors. An allotting circuit allots the signals from the hall call detector to the elevator car according to the area determined by the memory circuit.

14 Claims, 14 Drawing Figures

FIG. 2
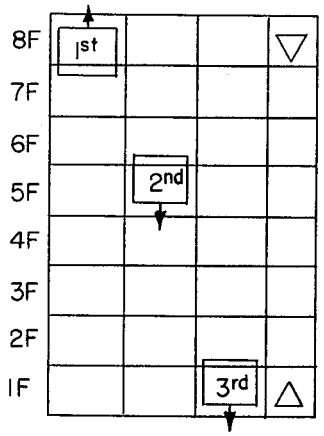
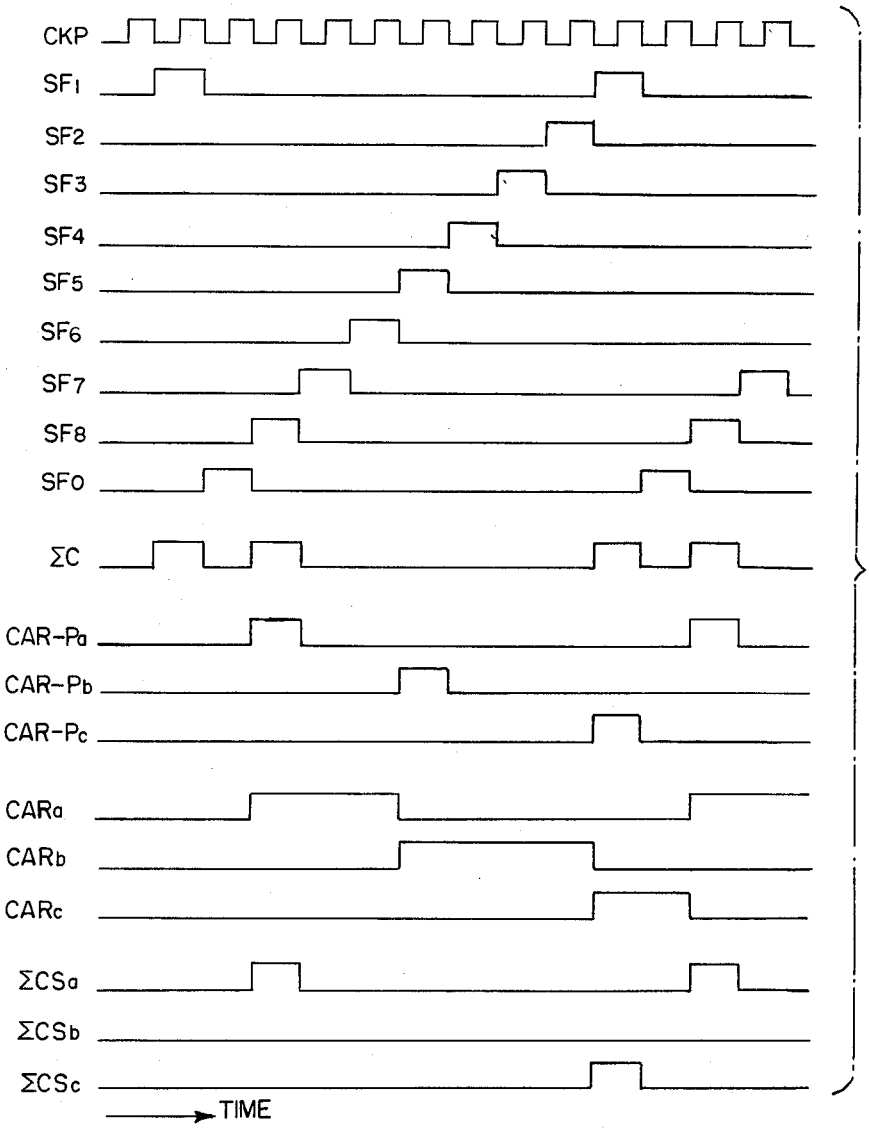
FIG. 3.

ELEVATOR CONTROL APPARATUS HAVING A NOVEL HALL CALL ALLOTTING DEVICE

BACKGROUND OF THE INVENTION

The invention relates to a control circuit for allotting hall calls to elevator cars in an elevator car system in which a plurality of elevator cars serve a plurality of floors.

In a hall call allotting controller of the prior art, a pushbutton for registering a hall call is provided at each floor, and a plurality of contact switches for detecting the position of an elevator car are provided along a hatchway through which the elevator car travels. The controller is conventionally composed of many relays to which the outputs of the pushbuttons and the car detecting switches are led through many lines. Accordingly, an increase in the number of floors and the number of elevator cars provided in parallel for serving the floors results in an increase in the size and construction of the controller. Also, it results in a complication of and a difficulty in installing the wiring connected between the pushbuttons, the car detecting switches and the controller when the elevator car system is installed. Further, a controller capable of providing various special services, such as an express service for divided floors, becomes even more large and complex in size and construction.

SUMMARY OF THE INVENTION

An object of the present invention is to provide a reliable control circuit for allotting hall calls to elevator cars and for utilizing solid-state digital techniques thereby to reduce the size and cost thereof.

A further object of the present invention is to provide a hall call allotting circuit which reduces the difficulty and complexity in the wiring thereof.

Still a further object of the present invention is to provide a hall call allotting circuit capable of providing express service for divided floors.

These and other objects have been attained by the hall call allotting control circuit comprising, a generator for generating a scanning signal which consists of scanning pulses, a hall call detector for generating a pulse when the number of a floor where the hall call occurs is equal to the number represented by said scanning signal, a plurality of elevator car detectors provided for corresponding elevator cars, each of which generates a pulse when a number of the floor where the elevator is positioned is equal to the number represented by said scanning signal, a memory circuit for generating pulse signals, each of which is generated upon appearance of a pulse from one of said elevator car detectors and survives until appearance of the next pulse from another of said car detectors, and a allotting circuit having a plurality AND gates, each of which outputs an allotted hall call signal for a corresponding elevator car when the pulse from said hall call detector is supplied thereto simultaneously with the pulse signal from said memory circuit.

BRIEF DESCRIPTION OF DRAWINGS

FIG. 2 is a diagram indicating the positions of cars and hall calls for explaining the operation of the control circuit shown in FIG. 1;

FIG. 3 shows waveforms of signals at the various parts of the control circuit shown in FIG. 1;

FIG. 10 (*b*) is a schematic circuit diagram showing an another embodiment of the elevator car detector shown in FIG. 4;

DETAILED DESCRIPTION OF THE PREFERRED EMBODIMENTS

Figure 1:
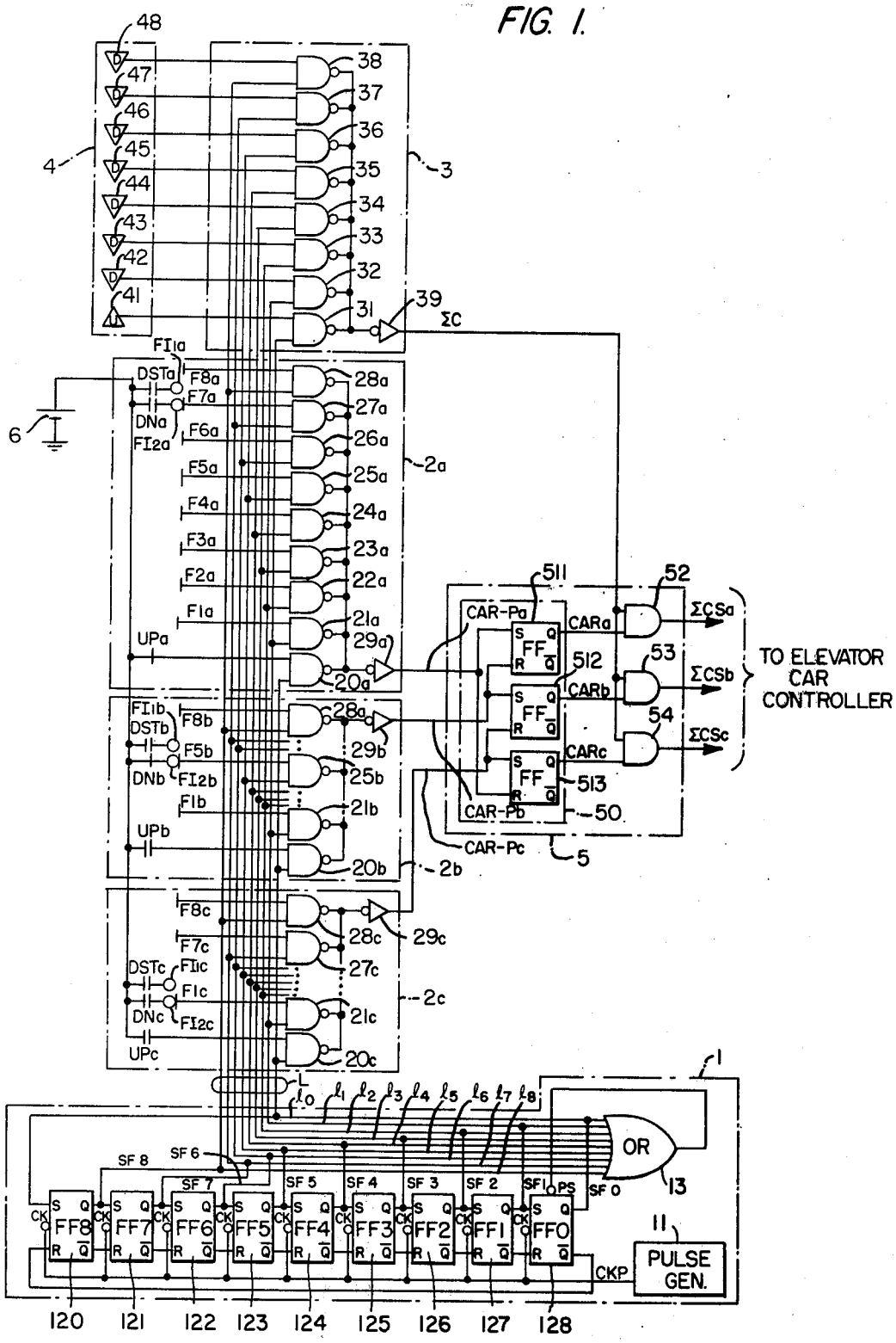
FIG. 1 is a schematic circuit diagram illustrating an embodiment of a control circuit for allotting a hall call to elevator cars according to this invention.

Referring now to FIG. 1, there is illustrated an embodiment of a control circuit for allotting car calls to elevator cars according to this invention. This embodiment is adapted for use in an elevator car system, in which down calls mainly occur, such as in a system for a hotel. In this embodiment, three cars are provided in parallel for serving eight floors, and a scanning signal is utilized for detecting car calls and the positions of the elevator cars.

The scanning signal generated by a scanning signal generator 1 is fed to a car call detector 4 and elevator car detectors 2*a*, 2*b*, 2*c* through a bus L consisting of nine lines $1_0$ to $1_8$. The scanning signal generator 1 includes a clock pulse generator 11 and nine flip-flops 120 to 128 which are connected in tandem to one another. Each of the flip-flops 120 to 128 has two terminals S and R and two output terminals Q and $\overline{Q}$, and produces a respective scanning pulse at the Q output terminal. The scanning signal consists of the scanning pulses $SF_0$ to $SF_8$, each of which is connected to the corresponding lines $1_0$ to $1_8$ and to corresponding input terminals of an OR gate 13. The line $1_0$ is further connected to the S input terminal of the flip-flop 120, and the output terminal of the OR gate 13 is connected to a PS input terminal of the flip-flop 128. The output terminal of the flip-flop 128 is connected to the R input terminal of the flip-flop 120. As shown in FIG. 3, one pulse is shifted for every clock pulse from one flip-flop to the next one so that the Q outputs of the respective flip-flops become the scanning pulses $SF_0$ to $SF_8$.

Hall calls, such as a down call and an up call, are registered by pushbutton 4 mounted in each corridor.

An up pushbutton 41 is located at the first floor and down pushbuttons 42 to 48 are located at the second to eighth floors. The car calls registered by the pushbutton 4 are processed into a car call signal ΣC through a car call detector 3. Each of the pushbuttons 41 to 48 is connected to a corresponding one of the NAND gates 31 to 38 at one input terminal thereof. All the output terminals of the NAND gates 31 to 38 are connected in common to an input terminal of an inverter 39. Each of the eight scanning pulses $SF_1$ to $SF_8$ of the scanning signal from the generator 1 is fed to a corresponding one of the NAND gates 31 to 38 at the other input terminal thereof. Only the NAND gate receiving the car call registered by the pushbutton is opened, and the scanning pulse is provided at the output terminal of the inverter 39 as the car call signal ΣC.

The positions of the three cars are detected by elevator car detectors 2*a*, 2*b*, 2*c* respectively. The elevator car detectors 2*a*, 2*b*, 2*c* are similar to one another in construction and operation. The respective elevator car detectors are distinguished by suffixes *a*, *b*, and *c*. Consequently, only the elevator car detector 2*a* for detecting the position of the first elevator car will be explained fully and in detail. Eight floor contacts, such as a first floor contact $F_{1a}$ located at the first floor and contacts $F_{2a}$ to $F_{8a}$ located at the others, are provided along a hatchway through which the first elevator car travels. On the other hand, a pair of shifting contacts $FI_{1a}$ and $FI_{2a}$ are mounted on the elevator car opposite to the floor contacts $F_{1a}$ to $F_{8a}$. The shifting contacts $FI_{1a}$ and $FI_{2a}$ are connected to a d.c. voltage source 6 through respective contact switches DSTa and DNa. The shifting contacts $FI_{1a}$, $FI_{2a}$ travel with the elevator car and come into contact with the contact corresponding to the floor at which the elevator car is positioned at that time. Each of the floor contacts F1*a* to F8*a* is connected to corresponded NAND gates 21*a* to 28*a* at one input terminal thereof. Another NAND gate 20*a*, which has one input terminal connected the d.c. voltage source 6 through a contact switch UPa, is provided for detecting the upward traveling of the elevator car. The contact switch DSTa is closed when the elevator car is traveling downward and the contact switch DNa is closed when the elevator car is standing at any floor. Each output terminal of the NAND gates 20*a* to 28*a* are connected to an input terminal of an inverter 29*a*. A signal CAR-Pa informing the position of the first elevator car is provided at the output terminal of the inverter 29*a*. Other signals, such as a CAR-Pb signal CAR-Pc signal, are produced by the other elevator car detectors 2*b*, 2*c* in the same way as that above mentioned.

An allotting circuit 5 receives the signals CAR-Pa, and CAR-Pb, CAR-Pc from the elevator car detectors 2*a*, 2*b*, 2*c* and the car call signal ΣC from the car call detector 3. Each of the hall calls is allotted to proper cars in a manner that will be mentioned afterward. The signals CAR-Pa, CAR-Pb, CAR-Pc are processed into signals CARa, CARb, CARc through a memory circuit 50. The memory circuit 50 latches information provided at the input terminal thereof until the next information is provided. The memory circuit 50 consists of flip-flops 511, 512 and 513. The output terminal of the elevator car detector 2*a* is connected to both of the S input terminal of the flip-flop 511 and the R input terminal of the flip-flop 513. The output terminal of the elevator car detector 2*b* is connected to both of the S input terminal of the flip-flop 512 and the R input terminal of the flip-flop 511. The output terminal of the elevator detector 2*c* is connected to both of the S input terminal of the flip-flop 513 and the R input terminal of the flip-flop 512. When the CAR-Pa signal is at the "1" level, the flip-flop 511 is set and the flip-flop 513 is reset. This condition is maintained until the appearance of next signal. When the voltage of the CAR-Pb signal is at the "1" level, the flip-flop 511 is reset and the flip-flop 512 is set. Therefore, the CARa signal is produced at the Q output terminal of the flip-flop 511. In like manner, the signals CARb, CARc are produced at the Q output terminals of the flip-flops 512 and 513, respectively. Each of the signals CARa, CARb, CARc is fed to a corresponding one of the AND gates 52, 53, 54 at one input terminal thereof. The car call signal ΣC from the car call detector 3 is fed to each of the AND gates 52, 53 and 54 at the other end. Allotted hall call signals ΣCSa, ΣCSb, ΣCSc are produced at the output terminals of the AND gates 52, 53, 54 respectively, and are fed to an elevator car controller as one of the control factors for controlling the elevator cars.

Operation of the above described control circuit is given with reference to FIGS. 2 and 3. As shown in FIG. 2, now assuming that the up pushbutton 41 located at the first floor and the down pushbutton 48 located at the eighth floor are pushed, at the moment the first elevator car travels upward near the eighth floor, and the second and third elevator cars travel downward near fifth and first floors respectively. In the car call detector 3, the hall calls registered by the pushbuttons 41 and 48 are fed to the NAND gates 31 and 38 as one input respectively. Therefore, only the scanning pulses $SF_1$ and $SF_8$ pass through the NAND gates 31 and 38 and the car call signal ΣC shown in FIG. 3 is provided at the output terminal of the inverter 39.

Since the first elevator car travels upward, the contact switch UPa is closed and the voltage of the d.c. voltage source 6 is fed to the one input terminal of the NAND gate 20*a*. The contact switches DNb, DNc are opened since the second and third elevator cars travel downward. The shifting contacts FI2b, FI2c mounted on respective elevator cars are brought into contact with the fifth floor contact $F_{5b}$ and the first floor contact $F_{1c}$ respectively and the voltage of the d.c. voltage source 6 is fed to each of the one input terminals of the NAND gates 25*b* and 21*c*. The scanning pulses $SF_0$, $SF_5$, $SF_1$ pass through the NAND gates 20*a*, 25*b*, 21*c* respectively, and the signals CAR-Pa, CAR-Pb, CAR-Pc shown in FIG. 3 are produced at each of the inverters 29*a*, 29*b*, 29*c*. The signals CAR-Pa, CAR-Pb, CAR-Pc are converted into the signals CARa, CARb, CARc by the operation of the memory circuit 50. Each pulse width of the signals CARa, CARb, CARc indicates the service area of the corresponding elevator cars. That is, each of the signals CARa, CARb, CARc opens the corresponding AND gates 52, 53, 54 during the pulse width thereof. Therefore, the allotted hall call signals CSa, CSb, CSc are produced at the output terminals of the AND gates 52, 53, 54 respectively. As shown in FIG. 3, the hall call which occurs at the eighth floor is allotted to the first elevator car and the hall call which occurs at the first floor is allotted to the third elevator car.

Figure 4:
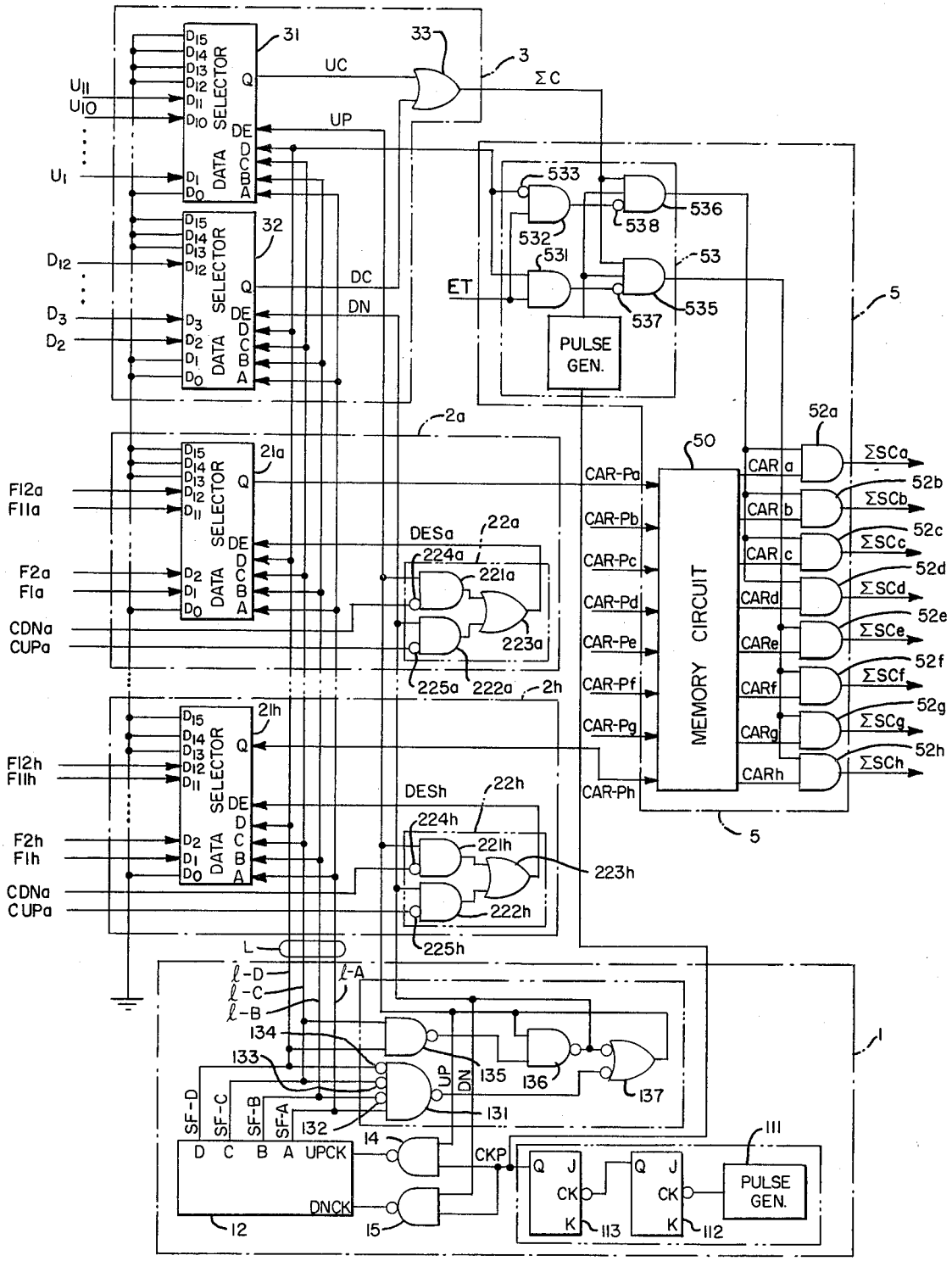
FIG. 4 is a schematic circuit diagram illustrating another embodiment of a control circuit according to this invention.

Referring now to FIG. 4, there is illustrated a control circuit of another embodiment according to this invention. This circuit is adapted for use in an elevator car system in which eight cars are provided in parallel for serving twelve floors. This circuit is able to be adapted to an elevator car system which provides express service for divided floors for example during rush hour.

Under the express service for divided floors, all installed elevator cars are grouped into a few groups. Further floors served by the elevators are also divided into a plurality of floor groups. A certain elevator car group serves only a particular floor group. During the time an elevator car of the certain group travels within floors of another floor, group, the elevator car does not serve the floor and therefore merely passes through the other floor group passively. In this embodiment, the car calls occuring at the higher floors than the eighth floor are allotted to the first to fourth elevator cars and the car calls occuring at the lower floors than the seventh floor are allotted to the fifth to eighth elevator cars. The first to fourth elevator cars travel from the first floor to the higher floors without standing at any lower floors. That is, express service is provided for the divided group of the higher floors.

In this embodiment, a binary coded scanning signal is used for detecting car calls and car positions. A scanning signal generator 1 includes a clock pulse generator 11 generating clock pulse CKP, a binary counter 12, which counts up or counts down the clock pulse CKP and outputs the binary coded scanning signal, and an up-down controller 13 controlling the up-counting or down-counting operation of the binary counter 12. A pulse generated by a pulse generator 111 is supplied to a CK input terminal of a flip-flop 112 which outputs a pulse at a CK input terminal of a flip-flop 113. A clock pulse CKP having half the frequency of that from the flip-flop 112 is provided at an output terminal of the flip-flop 113. The binary counter 12 has two input terminals, an up-counting input terminal UPCK and down-counting input terminal DNCK, and four output terminals A, B, C and D. The output terminal of the flip-flop 113 is connected to the input terminals UPCK, DNCK of the binary counter 12 through respective NAND gates 14 and 15. The NAND gates 14 and 15 are controlled by the up-down controller 13. The counter 12 counts up the clock pulse CKP during the time the NAND gate 14 is opened; on the other hand, it counts down the clock pulse CKP during the time the NAND gate 15 is opened. The binary counter 12 outputs pulses SF-A, SF-B, SF-C, SF-D at the four output terminals thereof. The signal consisting of pulses SF-A, SF-B, SF-C, and SF-D indicates the counted number of the clock pulse CKP in a binary code.

The up-down controller 13 opens the NAND gate 14 until the counted number comes up to twelve. When the counted number comes up to twelve, the NAND gate 15 is open and the binary counter 12 starts down-counting. The pulse SF-A is provided at one input terminal of a NAND gate 131 and the pulses SF-B, SF-C, SF-D are provided at the other terminals thereof through inverters 132, 133, 134 respectively. At the same time, the pulses SF-C and SF-D are applied to two input terminals of a NAND gate 135. The output of the NAND gate 135 is fed to a NAND gate 136 as one input thereof. An output DN is fed to the NAND gate 15 at another input and to a NOR gate 137. The output from the NAND gate 136 is fed to the NOR gate 137 at another input terminal. The output UP from the NOR gate 137 is fed to both of the NAND gates 14 and 136 at another input terminal.

Figure 7:
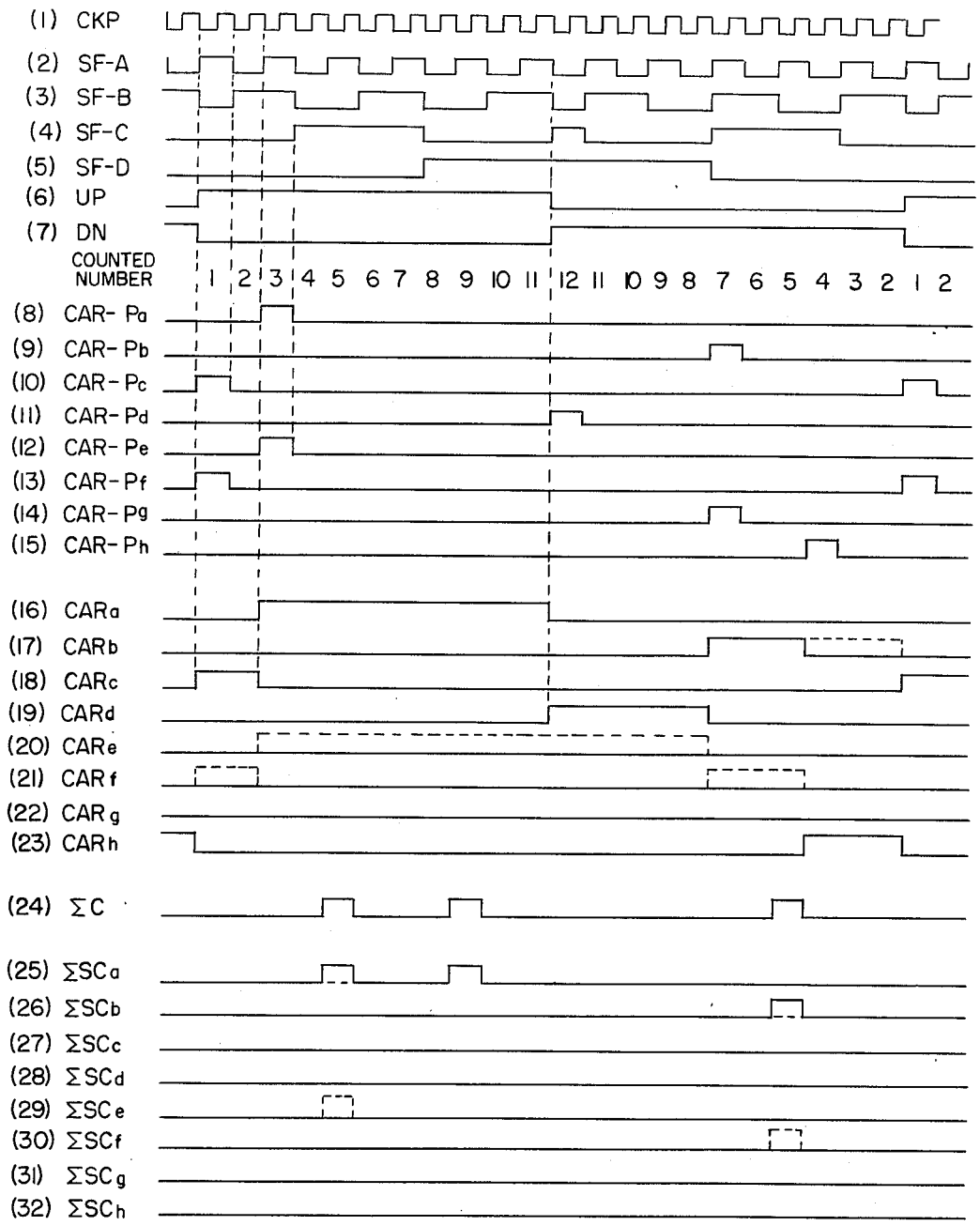
FIG. 7 shows waveforms of signals at various parts of the control circuit shown in FIG. 4.

When the NAND gate 14 is opened by the UP output from the up-down controller 13 and the counted number of the binary counter 12 comes up to the twelve, i.e. both of the SF-A and SF-B are at the "0" level and the others SF-C and SF-D are at the "1" level, the voltage of the output from the NAND gate 135 turns to the "0" level. Thereby, the voltage of the output DN from the NAND gate 136 turns to the "1" level and the clock pulse CKP is provided at the DNCK input terminal of the binary counter 12. The waveforms of the pulses CKP, SF-A, SF-B, SF-C, SF-D, UP and DN are shown in FIG. 7.

In the same manner as that of the foregoing embodiment, hall calls are registered by pushbuttons, such as up pushbuttons $U_1$ to $U_{11}$ located at every floor except the top floor and down pushbuttons $D_2$ to $D_{12}$ located at every floor except the first floor, and outputs thereof are fed to a car call detector 3. The hall call detector 3 which includes two data selectors 31 and 32 develops the hall calls into a hall call signal ΣC. Each up hall call $U_1$ to $U_{11}$ registered by the up pushbuttons is fed to corresponding input terminals $D_1$ to $D_{11}$ of the data selector 31. In like manner, each down call $D_2$ to $D_{12}$ is registered by the down pushbuttons and fed to corresponding input terminals $D_2$ to $D_{12}$ of the data selector 32. The binary coded scanning signal consisting of the pulses SF-A to SF-D is fed to the data selectors 31 and 32 through a bus L consisting of lines 1-A to 1-D. Each of the lines 1-A to 1-D at which the pulses SF-A to SF-D are provided is connected to corresponding input terminals A to D of the data selector 31 and 32. Each of the data selector 31 and 32 will produce a signal at its Q terminal when the number of binary coded scanning signals is equal to the number of the input terminal at which the hall call appears. The data selector 31 operates during the time when the output UP from the up-down controller 13 is at the "1" level, and the data selector 32 operates during the time when output DN from the controller 13 is at the "1" level. The output signals UC and DC from the data selectors 31 and 32 are fed to an OR gate 33, which produces a hall call signal ΣC at the output terminal thereof.

The position of each elevator car is detected by floor contacts located at the respective floors and by a shifting contact which travels with the elevator car. Only the first elevator car detector **2*a* for detecting the position of the first elevator car is explained in detail since it is similar to and therefore representative of the other elevator car detectors 2*b* to 2*h* is construction and operation. The elevator car detector 2*a* includes a data selector similar to that of the hall call detector 3 as well as a selector controller 22*a*. Signals from floor contacts F1*a* to F12*a* are connected to corresponding input terminals $D_1$ to $D_{12}$ of the data selector 21*a*. The positions of the cars are detected in the same way as shown in FIG. 1. Each of the pulses SF-A to SF-D of the binary coded scanning signal is provided at input terminal A, B, C, D of the data selector 21*a*. The data selector 21*a* produces a car pulse CAR-Pa at the Q terminal thereof. The selector controller 22*a* controls the operation of the data selector 21*a*** according to the traveling direction of the elevator car.

Signals CDNa and CUPa indicate the traveling direction of the first car. The signal CDNa is at "1" level during the time the car travels downward; on the other hand the CUPa signal is at the "1" level during the time the car travels upward. The signals CDNa, CUPa are supplied to AND gates **221*a* and 222*a* through inverters 224*a* and 225*a*, respectively. The output terminals of the AND gates 221*a*, 222*a* are connected to an OR gate 223*a*. An output DESa from the OR gate 223*a* is provided at the DE input terminal of the data selector 21***a*. When the car travels downward and the binary counter 12 counts down, the CDNa signal and the DN output are at the "1" level and the CUPa signal and the UP output are at "0" level. Therefore, the signal DESa at the "1" level is provided at the DE terminal of the data selector 21*a* which is enabled to operate. In the same way, when the car travels upward and the binary counter 12 counts up, the signal DESa is at the "1" level to enable the data selector 21*a* to function. On the other hand, when the traveling direction of the elevator car and the counting direction of the scanning signal are opposed, i.e. the car travels downward and the binary counter 12 counts up, or the car travels upward and the binary counter 12 counts down, the DESa signal is at the "0" level. Therefore, the data selector can not function. In case the car is landing at any floor, both of the signals CDNa and CUPa are at the "0" level. The DESa signal is always at the "1" level in such case. Therefore, the data selector 21*a* is always enabled to function when the car is landing.

An allotting circuit 5 includes a memory circuit 50, AND gates 52*a* to 52*h* and an express service controller 53. Each of the outputs CAR-Pa to CAR-Ph is developed into signals CARa to CARh through the memory circuit 50, respectively. The detailed description of the memory circuit 50 will be given afterward. Each of the signals CARa to CARh is fed to corresponding AND gates 52*a* to 52*h* at one input terminal thereof. The hall call signal ΣC is fed to the express service controller 53 which has two output terminals. One of the two output terminals of the express service controller 53 is connected to a respective input of each of the four AND gates 52*a* to 52*d* and the other is connected to a respective input of each of the AND gates 52*e* to 52*h*. A signal ET indicating the requirement of the express service is fed to each of AND gates 531, 532 at one input terminal thereof. The pulse SF-D from the binary counter 12 is fed to the AND gate 531 at the other input terminal and to the AND gate 532 through an inverter 533 at the other input terminal. A stroke pulse generator 534 receives the clock pulse CKP from the clock pulse generator 11 through a line L-CKP and generates a stroke pulse. The stroke pulse is fed to each of AND gates 535 and 536. Each of the AND gates 535, 536 has a first input terminal provided with the hall call signal ΣC, a second input terminal provided with the stroke pulse, and a third input terminal provided with an inverter 537 or 538. Each output terminal of the AND gates 531, 532 is connected to the corresponding third input terminals of the AND gates 535, 536 through the inverters 537 and 538.

Under normal operation, the ET signal is at the "0" level, and the output of AND gates 531, 532, which are at the "0" level, are reversed by the inverter 537, 538 respectively. Each of the reversed signals at the "1" level is fed to the corresponding AND gates 535, 536. Therefore, the car signal ΣC appears at both the output terminals of the AND gates 535, 536 synchronously with the stroke pulse.

Under the operation of the express service for divided floors, the signal ET at "1" level is fed to the AND gates 531, 532. When the SF-D signal is at the "0" level, i.e. the counted number of the binary counter 12 is less than eight, the AND gate 532 generates a signal at level "1" and the AND gate 531 outputs a signal at level "0". The signals are reversed by the inverter 537 so that a signal at "1" level is supplied to the AND gate 535 and a signal at the "0" level is supplied to the AND gate 536. Therefore, the ΣC signal appears at the output terminal of the AND gate 535 synchronously with the stroke pulse from the stroke pulse generator 534, and is supplied to each of the AND gates 52*e* to 52*h*. On the other hand, when the SF-D signal is at "1" level, i.e. the counted number is more than eight, a signal at the "0" level is supplied to the third input terminal of the AND gate 536 and a signal at the "1" level is supplied to that of the AND gate 535. Therefore, the signal ΣC appears at the output terminal of the AND gate 536 synchronously with the stroke pulse, and is supplied to each of the AND gates 52*a* to 52*d*. As apparent from the above description, the hall calls which occur at the lower floors than the seventh floor are allotted to the fifth to eighth elevator cars and the hall calls which occur at the higher floors than the eighth floor are allotted to the first to fourth elevator cars.

Figure 5:
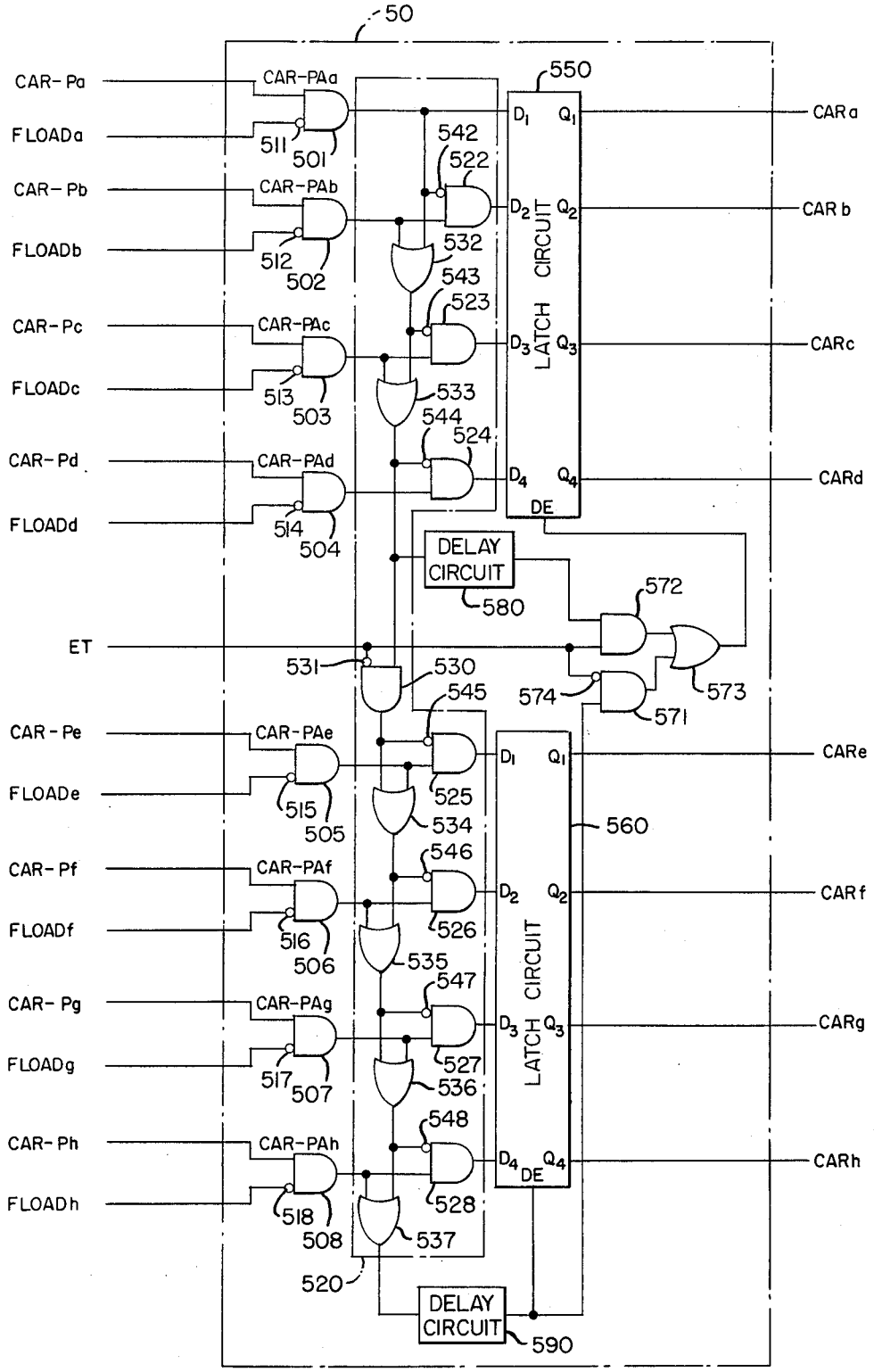
FIG. 5 is a schematic circuit diagram showing a memory circuit suitable for use in the control circuit shown in FIG. 4.

In FIG. 5, there is shown a schematic diagram of a circuit which may be used for the memory circuit 50 shown in FIG. 4. This circuit includes latch circuits 550, 560 generating the signals CARa to CARh and a priority circuit 520. The latch circuits 550, 560 operate in cooperation with each other under the normal operation, and operate independently under the express service operation.

Each of the signals CAR-Pa to CAR-Ph from the elevator car detectors 2*a* to 2*h* shown in FIG. 4 is supplied to corresponding AND gates 501 to 508 at one input terminal thereof. Signals FLOADa to FLOADh, which indicate that the corresponding car is filled with the predetermined number of passengers, are supplied to the corresponding AND gates 501 to 508 through inverters 511 to 518. The output terminal of the AND gate 501 is connected to a $D_1$ input terminal of the latch circuit 550. The output terminal of the AND gate 502 is connected to one input terminal of an AND gate 522 which has another input terminal connected to the output terminal of the AND gate 501 through an inverter 542. The output terminal of the AND gate 522 is connected to the $D_2$ input terminal of the latch circuit 550. The output terminal of the AND gate 503 is connected to an input terminal of an AND gate 523 which has another input terminal connected to an output terminal of an OR gate 532 through an inverter 543. The output terminal of the AND gate 523 is connected to the $D_3$ input terminal of the latch circuit 550. The OR gate 532 has two input terminals which are connected to the output terminals of the AND gates 501, 502 respectively. The output terminal of the AND gate 504 is connected to an input terminal of an AND gate 524 which has another input terminal connected to an output terminal of an OR gate 533 through an inverter 544. The output terminal of the AND gate 524 is connected to the $D_4$ input terminal of the latch circuit 550. The OR gate 533 has two input terminals connected to the output terminals of the AND gate 503 and the OR gate 532 respectively, and an output terminal thereof is connected to an AND gate 530 at one input terminal and to delay circuit 580.

The output terminal of the AND gate 505 is connected to one input terminal of an AND gate 525 which has another input terminal connected to the output terminal of the AND gate 530 through an inverter 545. The output terminal of the AND gate 525 is connected to the $D_1$ input terminal of the other latch circuit 560. The output terminal of the AND gate 506 is connected to one input terminal of an AND gate 526 which has another input terminal connected to the output terminal of an OR gate 354 through an inverter 546. The OR gate 534 has two input terminals connected to the output terminals of the AND gates 530 and 505. The output terminal of the AND gate 526 is connected to the $D_2$ input terminal of the latch circuit 560. The output terminal of the AND gate 507 is connected to one input terminal of an AND gate 527 which has another input terminal connected to the output terminal of an OR gate 535 through an inverter 547. The output terminal of the AND gate 527 is connected to the $D_3$ input terminal of the latch circuit 560. The OR gate 535 has two input terminals connected to the output terminals of the AND gate 506 and the OR gate 534, respectively. The output terminal of the AND gate 508 is connected to one input terminal of an AND gate 528 which has another input terminal connected to the output terminal of an OR gate 536 through an inverter 548. The OR gate 536 has two input terminals connected to the output terminals of the AND gate 507 and the OR gate 535, respectively. The output terminal of the AND gate 528 is connected to the $D_4$ input terminal of the latch circuit 560. An OR gate 537 has two input terminals connected to the output terminals of the AND gate 508 and the OR gate 536, and an output terminal connected to the DE input terminal of the latch circuit through an delay circuit 590.

The operation of the circuit above described is as follows. If the first car is filled with the predetermined maximum number of passengers, the signal FLOADa at the "1" level is supplied to the inverter 511 which outputs a signal at the "0" level to the AND gate 501. Therefore, the signal CAR-Pa is inhibited from being supplied to the latch circuit 550 which produces the signal CARa determining the service area of the first elevator car for the hall calls. The priority circuit 520 gives the priority to the elevator car having the smaller car number when two or more elevator cars are found at the same floor and at the same time. For example, if the first and fourth elevator cars during upward travel are found at the third floor at the same time, the signals CAR-Pa and CAR-Pd are supplied to the AND gates 501 and 504 at the same time. The signal CAR-Pa passes through the AND gate 501 and is fed to the $D_1$ terminal of the latch circuit 550. At the same time, the signal CAR-Pa passes through the OR gates 532, 533 and the inverter 544 and is supplied to the AND gate 524. The signal CAR-Pd is inhibited from being supplied to the latch circuit 550 during the pulse width of the signal CAR-Pa.

The latch circuits 550, 560 have the same operation as the memory circuit shown in FIG. 1, and are reset by inputs supplied to the DE terminal thereof. The ET signal is supplied to the other input terminal of an AND gate 530 through an inverter 531. The signal ET is further supplied to one input terminal of an AND gate 572 and to one input terminal of an AND gate 571 through an inverter 574. Each of the AND gates 571 and 572 has another input terminal which is connected to the respective delay circuits 590 and 580. An OR gate 573 has two input terminals connected to the output terminals of the AND gates 571 and 572 and an output terminal connected to the DE input terminal of the latch circuit 550.

Figure 8:
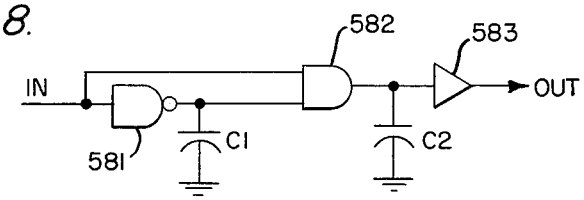
FIG. 8 is a schematic circuit diagram showing a delay circuit suitable for use in the memory circuit shown in FIG. 5.

Under normal operation, the output from the delay circuit 580 is inhibited by the AND gate 572 since the signal ET is at the "0" level. An output at the "1" level reversed by the inverter 574 is supplied to the AND gate 571, the output from the delay circuit 590 is supplied through AND gate 571 and the OR gate 573 to the DE input terminal of the latch circuit 550. Accordingly, both of the latch circuits 550 and 560 are reset by the output from the delay circuit 590. On the other hand, under the operation of the express service, the signal ET turns into the "1" level. The AND gate 530 to which a reversed ET signal at "0" level is supplied inhibits the output of the OR gate 533 from being supplied to the OR gate 534. The output from the delay circuit 580 is supplied through the AND gate 572 and the OR gate 573 to the DE input terminal of the latch circuit 550 since the signal ET at "1" level is supplied to the AND gate 572. Therefore, each of the delay circuits 580, 590 resets the corresponding latch circuits 550, 560 with delay time thereof. The delay circuits 580, 590 are shown in FIG. 8,9 in more detail.

Figure 6:
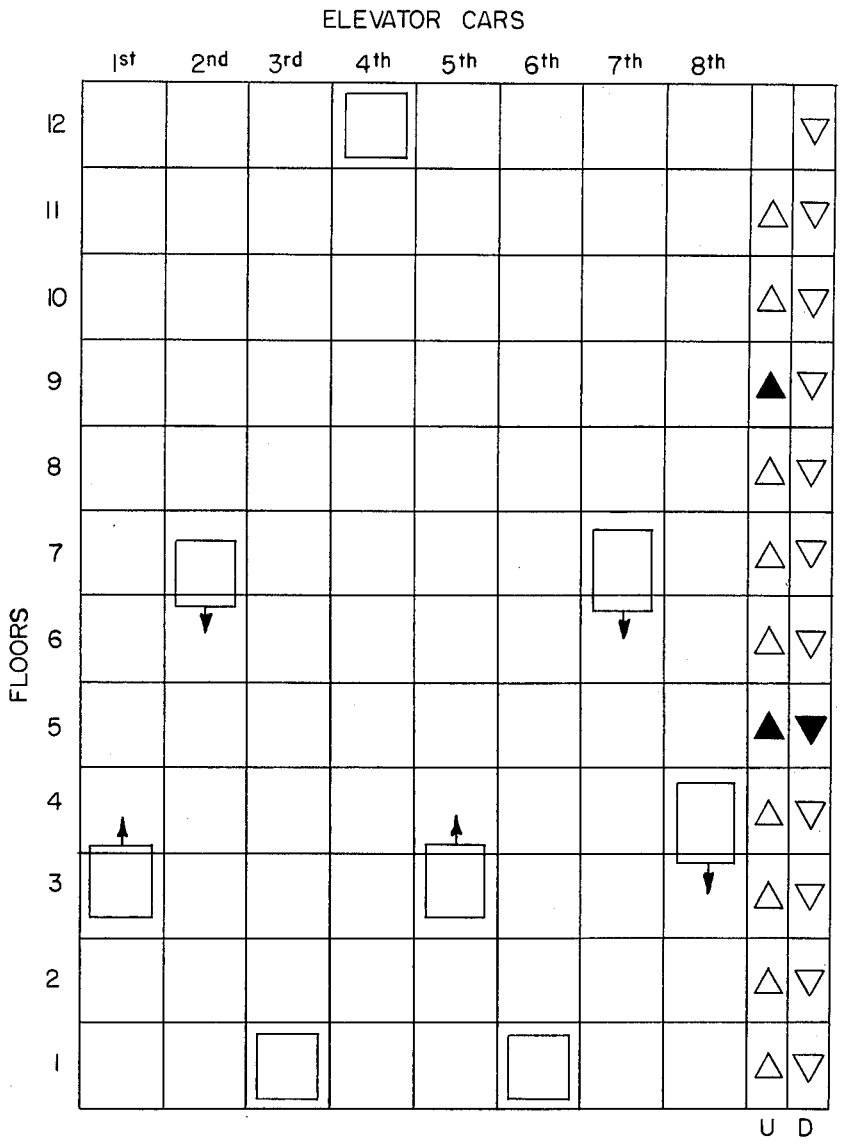
FIG. 6 is a diagram indicating the positions of elevator cars and hall calls for explaining the operation of the control circuit shown in FIG. 4.

The operation of the circuit above described is given with reference to FIGS. 6 and 7. As shown in FIG. 6, it is assumed that the up pushbuttons $U_5$, $U_9$ and the down pushbutton $D_5$ are pushed, at the moment the first car is traveling upward near the third floor, the second car is traveling downward near the seventh floor, the third car is landing at the first floor, the fourth car is landing at the twelveth floor, the fifth car is traveling upward near the third floor, the sixth car is landing at the first floor, the seventh car is traveling at the seventh floor and the eighth car is traveling downward near the fourth floor.

When the signal UP is at the "1" level, the data selector 31 detects the up calls registered by the up pushbuttons. The data selector 31 generates a pulse when the counted number of the binary counter 12 comes up to be equal to five or nine. When the signal DN is at the "1" level, the data selector 32 detects the down calls registered by the down pushbutton. The data selector 32 generates a pulse when the counted number comes down to be equal to five. The pulses generated by the data selectors 31, 32 are fed to the OR gate 33 which produces the hall call signal ΣC at the output terminal.

The elevator car detectors *2a* to *2h* detect the positions of the elevators. For example, the position of the first car is detected by the elevator car detector *2a* as follows. When the binary counter 12 counts up, the signal UP is at the "1" level. The selector controller *22a* outputs a signal at the "1" level since the counting direction of the binary counter 12 is in the same direction of the traveling direction of the first elevator car. The data selector *21a* generates the signal CAR-Pa when the counted number of the binary counter 12 comes up to be equal to three. As shown in FIG. 7 (9) to (15), the other signals CAR-Pb to CAR-Ph are produced in the same manner.

Under the normal operation, the signals CAR-Pa to CAR-Ph from the elevator car detectors *2a* to *2h* are developed into the signals CARa to CARh in the following manner. As shown in FIG. 7 (16)–(23), when the counted number of the binary counter 12 is equal to three, i.e. the signals SF-A, SF-B are at "1" and the other signal SF-C, SF-D are at "0" level, the signals CAR-Pa and CAR-Pe are fed to the memory circuit 51 at the same time. By function of the priority circuit 520, the CAR-Pa signal is fed to the latch circuit 550 and the CAR-Pe signal is inhibited from being supplied to the latch circuit 560. Accordingly, only the signal CARa is produced. The pulse signal CARa is maintained until the CAR-Pd signal is fed to the latch circuit 560. The pulse width of the signal CARa indicates a service area of the first car for the hall calls. Since the up calls occurring at the fifth and ninth floors are within the pulse width of the CARa signal, the up calls are allotted to the first elevator car. The down call occurring at the fifth floor is allotted to the second elevator car in the same manner.

Under express service operation, the latch circuits 550, 560 operate independently of each other, i.e. the latch circuit 550 receives the signals CAR-Pa to CAR-Pd and generates the signals CARa to CARd, and the latch circuit 560 receives the signals CAR-Pe to CAR-Ph and generates the signals CARe to CARh. Therefore, the pulse width of the signal CARb extends as represented in broken line in FIG. 7 (17). The latch circuit 560 generates the pulse signals CARe and CARf represented in broken line in FIG. 7 (20), (21). Further, by the operation of the express service controller 53, the up and down hall calls occurring at the fifth floor are fed to the AND gates 52*e* to 52*h*, and the up hall call occurring at ninth floor is fed to the AND gates 52*a* to 52*d*. Accordingly, the up call occurring at the fifth floor is allotted to the fifth elevator car since it is within the pulse width of the signal, which is represented in broken line in FIG. 7 (20). In like manner, the down call occurring at the fifth floor is allotted to the sixth car and the up call occurring at the ninth floor is allotted to the first car.

Figure 9:
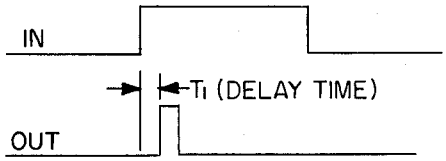
FIG. 9 show waveforms of input and output of the delay circuit shown in FIG. 8.

In FIG. 8, there is illustrated a schematic diagram of a circuit which may be used for the delay circuits 580 and 590 shown in FIG. 5. An input IN is fed to input terminals of a NAND gate 581 and an AND gate 582. The output terminal of the NAND gate 581 is grounded through a capacitor $C_1$ and also connected to another input terminal of the AND gate 582. The output terminal of the AND gate 582 is grounded through a capacitor $C_2$ and also connected to an input terminal of an amplifier 583 having a output terminal at which an delayed output signal OUT is provided. The waveforms of the input IN and the output OUT are shown in FIG. 9.

Figure 10A:
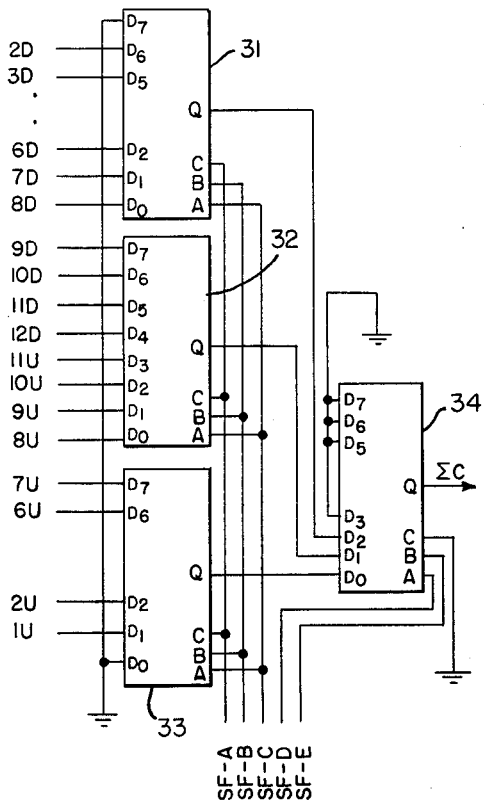
FIG. 10 (*a*) is a schematic circuit diagram showing an another embodiment of the hall call detector shown in FIG. 4.
Figure 10B:
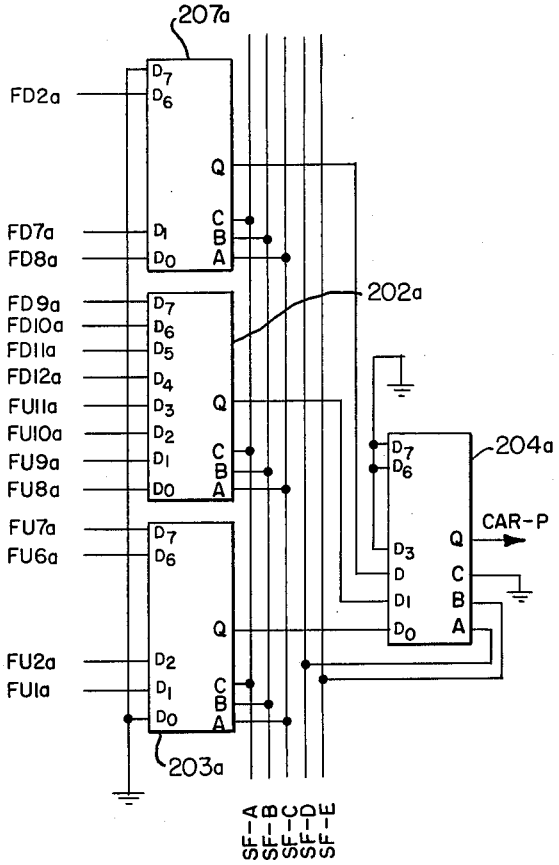

In FIG. 10(*a*) and FIG. (*b*), there are shown other embodiments of the hall call detector 3 and the elevator car detector 2*a* shown in FIG. 4, respectively. In the embodiments, each of the detectors 3 and 2*a* consists of four data selectors and utilizes a scanning signal consisting of five scanning pulses SF-A to SF-E. The scanning pulses SF-A to SF-D are the same pulse signals as shown in FIG. 4, and the other pulse SF-E has half the frequency of the pulse SF-D. The scanning signal will be described afterward.

In FIG. 10(*a*), each of the data selectors 31 to 34 has eight input terminals $D_0$ to $D_7$, to each of which the corresponding outputs $D_2$ to $D_{12}$, $U_{11}$ to $U_1$ are supplied, and another input terminal A, B, C, to each of which the corresponding scanning pulses SF-A, SF-B SF-C are supplied. Output terminals of the data selectors 31, 32, 33 are connected to respective input terminals $D_0$, $D_1$, $D_2$ of the other data selector 34 generating the hall call signal ΣC shown in FIG. 4 at a Q output terminal thereof. To each of the input terminals A, B of the data selector 34 the other scanning pulses SF-D, SF-E are supplied respectively. The other input terminal C of the data selector 34 is grounded.

As shown in FIG. 10(*b*), the embodiment of the elevator car detector has two groups of floor contacts. One group of contacts $FU_{1a}$ to $FU_{11a}$ operate to produce a signal when the elevator car travels upward, and the other group of contacts $FD_{12a}$ to $FD_{2a}$ operate when the elevator car travels downward. Each contact of both the contact groups $FU_{1a}$ to $FU_{11a}$ and $FD_{12}$ to $FD_2$ is connected to respective input terminals of three data selectors 201*a* to 203*a*, as shown in the figure. An output terminal of the data selectors 201*a* to 203*a* provides an output at corresponding input terminals $D_0$, $D_1$, $D_2$ of the other data selector 204*a*. In the same manner as shown in FIG. 10(*a*) the scanning pulses SF-A to SF-C are supplied to the data selectors 201*a* to 203*a* respectively and the other scanning signals SF-D, SF-E are supplied to the data selector 204.

The control circuit according to this invention gives various performance with attachment that are described afterward.

Figure 11:
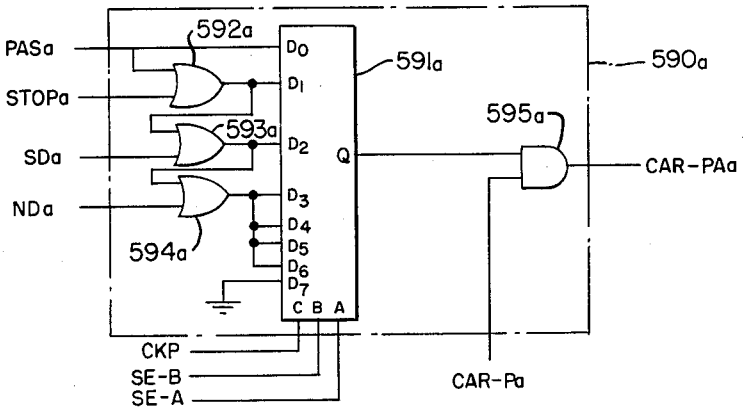
FIG. 11 is a schematic circuit diagram showing an attachment circuit for use in the memory circuit shown in FIG. 5.

In FIG. 11, there is illustrated a circuit of an attachment for use in the memory circuit 50 shown in FIG. 5. The circuit 590*a* receives the CAR-Pa signal from the elevator car detector 2*a* shown in FIG. 4, and generates a signal CAR-PAa with a delay time depending on the service condition of the car. A signal PASa is supplied to a data selector 591*a* at a $D_0$ input terminal and to an OR gate 592*a* at one input terminal. A signal STOPa is supplied to the OR gate 592*a* at another input terminal, and the output terminal thereof is connected to the $D_1$ input terminal of the data selector 591*a*. A signal SDa is supplied to one input terminal of an OR gate 593*a* which has another input terminal connected to the output terminal of the OR gate 592*a*. An output terminal of the OR gate 593*a* is connected to a $D_2$ input terminal of the data selector 591*a*. A signal NCa is supplied to an OR gate 594*a* at one input terminal. The OR gate 594*a* has another input terminal connected to the output terminal connected to input terminals $D_3$ to $D_6$ of the data selector 591. An input terminal $D_7$ of the data selector 591*a* is grounded. A clock pulse CKP is supplied to a C input terminal of the data selector 591*a* and signals SE-A and SE-B are supplied to input terminals A, B thereof. The signals SE-A, SE-B are described afterward. An output terminal Q is connected to one input terminal of an AND gate 595 and the signal CAR-Pa is provided at the other input terminal thereof. The CAR-PAa signal is produced at an output terminal of the AND gate 595.

The positive signals PASa, STOPa, SDa, NCa indicate that the car is traveling, is landing at any floor with moving direction, is in a decelerating operation, and is in a waiting condition without any moving direction, respectively. Each duration of the delay times of the signals PASa, STOPa, SDa and NCa is predetermined as being PASa<STOPa<SDa<NCa. By this control circuit, more suitable allotment of an individual elevator car for an individual hall call is achieved.

Figure 12:
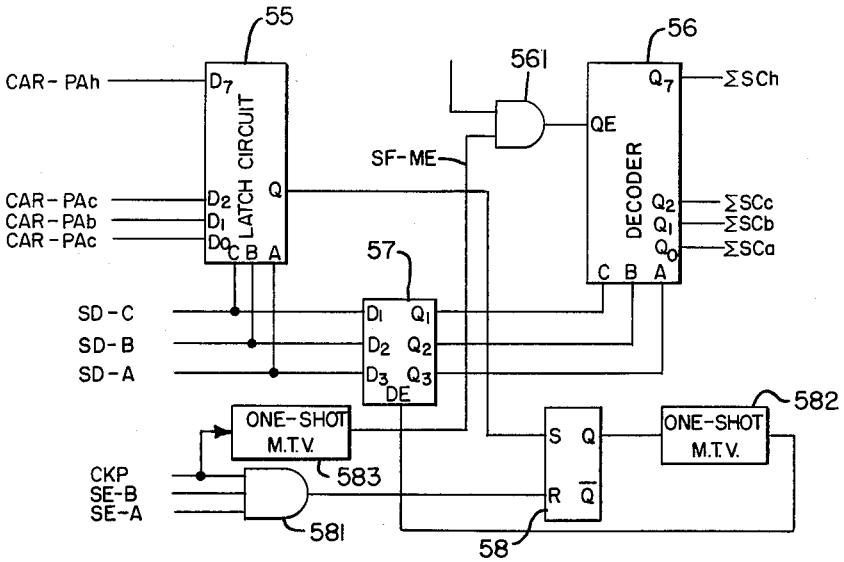
FIG. 12 is a schematic circuit diagram showing an another embodiment of the allotting circuit shown in FIG. 4.

In FIG. 12, there is shown an another embodiment of the allotting circuit 5 shown in FIG. 4. This circuit includes a data selector 55, a decoder 56, a latch circuit 57 and a flip-flop circuit 58. Each of the outputs CAR-PAa to CAR-PAh from the attachments shown in FIG. 11 is provided at corresponding input terminals $D_0$ to $D_7$ of the data selector 55, and each of the scanning pulses SD-A, SD-B, SD-C is provided at corresponding input terminals A, B, C thereof. The output signal from the data selector 55 is supplied to the flip-flop 58 at the S input terminal. The flip-flop 58 has another input terminal R to which an output from an AND gate 581 is supplied. The AND gate 581 has three input terminals, to each of which signals SE-A, SE-B and CKP are supplied. An output terminal Q of the flip-flop 58 is connected through an one-shot multivibrator 582 to a DE input terminal of the latch circuit 57. Each of the scanning pulses SD-A, SD-B, SD-C are provided at corresponding input terminals $D_1$, $D_2$, $D_3$ of the latch circuit 57. The latch circuit 57 has three output terminals $Q_1$, $Q_2$, $Q_3$, each of which is connected to corresponding input terminals C, B, A of the decoder 56. The decoder 56 has eight output terminals $Q_0$ to $Q_7$ and a input terminal QE to which an output terminal of an OR gate 561 is connected. The OR gate 561 has one input terminal at which the car call signal ΣC is provided, and the other input terminal at which the signal CKP is provided through an one-shot multivibrator 583.

The operation of the circuit above described is as follows. For example, if the positive CAR-PAa signal from the circuit shown in FIG. 11 is provided at the input terminal $D_0$ when the scanning signal SD-A, SD-B, SD-C is one in binary code, i.e. the pulse SD-A is at the "1" level and the other pulses SD-B, SD-C are at the "0" level, the data selector 55 produces an output signal setting the flip-flop 58.

The one-shot multivibrator 582 generates a pulse signal DE-P upon the output from the flip-flop 58. The pulse signal DE-P generated by the one-shot multivibrator 582 has a higher frequency than that of the pulse SD-A, and sets the latch circuit 57. The latch circuit 57 memolizes the scanning pulses SD-A, SD-B, SD-C when the pulse DE-P from the one-shot multivibrator 582 is provided at the DE input terminal thereof, and holds it until the appearance of the next pulse signal from the one-shot multivibrator 582 after the flip-flop 58 has been reset. At the same time, the other one-shot multivibrator 583 generates a pulse signal SF-ME upon receipt of the signal CKP. The pulse signal SF-ME opens the AND gate 561 and the hall call signal ΣC is supplied to the QE input terminal of the detector 56. Since the pulses provided at the input terminals A, B, C of the decoder 56 indicates one in binary code, the decoder produces a signal ΣSCa at the $Q_0$ terminal thereof. Therefore, the car call signal is allotted to the first car having a number equal to that stored by the latch circuit 57.

Figure 13:
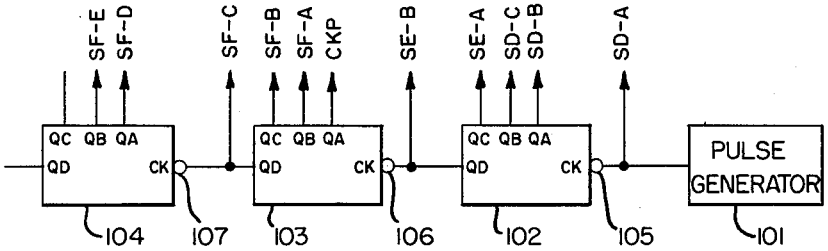
FIG. 13 is a schematic circuit diagram showing another embodiment of the scanning pulse generator shown in FIG. 4.

In FIG. 13, there is shown another embodiment of the scanning signal generator 1 shown in FIG. 4. This generator includes three binary counters 102, 103, 104, each of which has four output terminals QA, QB, QC, QD. An output terminal of a pulse generator 101 is connected to a CK input terminal of a first binary counter 102 through an inverter 105. The pulse generator 101 produces a signal SD-A at the output terminal thereof. The binary counter 102 counts the output signal SD-A from the pulse generator 101 and presents a counted number in binary code at the four output terminals QA to QD thereof. Each of signals SD-B, SD-C, SE-A SE-B is produced at output terminals QA to QD of the first binary counter 102. The signals SD-A, SD-B, SD-C are supplied to the allotting circuit shown in FIG. 12. The signals SE-A, SE-B are supplied to the circuit shown in FIG. 11 or 12. The second binary counter 103 receiving the signal SE-B through inverter 106 produces signals CKP, SF-A, SF-B and SF-C at the output terminals QA, QB, QC and QD. The output signal SF-C is supplied to the third binary counter 104 at the CK input terminal. The third binary counter 104 produces signals SF-D and SF-E at output terminals QA and QB thereof. The signals CKP, SF-A, SF-B, SF-C, SF-D and SF-C are fed to the circuit shown in FIG. 10(*a*), (*b*).

We claim:

1. A control circuit for allotting hall calls to elevator cars in an elevator system comprising:

generator means for generating a scanning signal which consists of a plurality of scanning pulses, hall call detector means for generating a signal when the number of the floor where a hall call occurs is equal to the number represented by said scanning signal, a plurality of elevator car detectors each provided for a corresponding elevator car, each of which generates a signal when the number of the floor where the elevator car is located is equal to the number represented by said scanning signal, memory circuit means for generating pulse signals, each of which is generated upon appearance of a signal from one of said elevator car detectors and remains until appearance of the next signal from another of said elevator car detectors, and an allotting circuit having a plurality of detecting means, each of which generates an allotted hall call signal for corresponding elevator cars when the pulse from said hall detector means is supplied thereto simultaneously with the pulse signal from said memory circuit means.

2. A control circuit as claimed in claim 1, wherein said scanning signal generator means includes a pulse generator connected to a binary counter which counts and generates a plurality of pulses indicating a counted number in binary code.

3. A control circuit as claimed in claim 1, wherein said memory circuit means comprises a plurality of flip-flops, the output of each elevator car detector being connected to the set input of one flip-flop and the reset input of one other flip-flop.

4. A control circuit as claimed in claim 3, wherein said allotting circuit comprises a plurality of gates each having one input connected in common to the output of said hall call detector means and a second input connected to the set output of a respective flip-flop.

5. A control circuit as claimed in claim 1, wherein said scanning signal generator means comprises binary counter means for counting up and down between maximum and minimum numbers and automatically reversing its count upon reaching said maximum and minimum numbers, the scanning pulses generated by said counter means representing a counted number in binary code.

6. A control circuit as claimed in claim 5, wherein each of said elevator car detectors includes means for indicating the direction of movement of the corresponding car and means for inhibiting operation of the detector when the indicated direction of movement of the car is opposite the direction of counting of said binary counter means.

7. A control circuit as claimed in claim 1, wherein said allotting circuit includes express service control means comprising means responsive to said scanning signal generator means for applying the output of said hall call detector means to some of said detecting means during a first period of counted numbers and to others of said detecting means during a second period of counted numbers generated by said generator means.

8. A control circuit for allotting hall calls to elevator cars in an elevator system comprising:

timing signal generator means for generating a plurality of sequential scanning pulses in a repetitive time frame representing the respective floors serviced by said elevator system;

hall call generating means for selectively generating hall calls associated with the respective floors serviced by said elevator system;

hall call detector means responsive to said timing signal generator means and said hall call generating means for generating a first signal upon detection of a hall call from a floor in coincidence with receipt of a scanning pulse representing that floor;

a plurality of elevator car detectors each provided for a corresponding elevator car to generate a second signal upon receipt of the scanning pulse representing the floor where the elevator car is located;

memory circuit means for individually storing each of said second signals from said elevator car detectors until the appearance of the next second signal from another of said elevator car detectors; and allotting means responsive to receipt of a first signal from said hall call detector means for applying a stored second signal from said memory circuit means as an allotted hall call signal to a corresponding elevator car.

9. A control circuit as claimed in claim 8, wherein said memory circuit means comprises a plurality of flip-flops, the output of each elevator car detector being connected to the set input of one flip-flop and the reset input of one other flip-flop.

10. A control circuit as claimed in claim 9, wherein said allotting means comprises a plurality of gates each having one input connected in common to the output of said hall call detector means and a second input connected to the set output of a respective flip-flop.

11. A control circuit for allotting hall calls to elevator cars in an elevator system comprising:

scanning signal generator means for generating a plurality of signals representing a sequential count designating the respective floors serviced by said elevator system;

hall call generating means for selectively generating hall calls associated with said respective floors;

hall call detector means responsive to said timing signal generator means and said hall call generator means for generating a first signal upon detection of a hall call from a floor at the time said generator means reaches a count representing that floor;

a plurality of elevator car detectors each provided for a corresponding elevator car to generate a second signal upon receipt of the scanning pulse representing the floor where the elevator car is located;

memory circuit means for individually storing each of said second signals from said elevator car detectors until the appearance of the next second signal from another of said elevator car detectors; and allotting means responsive to receipt of a first signal from said hall call detector means for applying a stored second signal from said memory circuit means as an allotted hall call signal to a corresponding elevator car.

12. A control circuit as claimed in claim 11, wherein said scanning signal generator means comprises binary counter means for counting up and down between maximum and minimum numbers and automatically reversing its count upon reaching said maximum and said minimum numbers, the scanning pulses generated by said counter means representing a counted number in binary code.

13. A control circuit as claimed in claim 12, wherein each of said elevator car detectors includes means for indicating the direction of movement of the corresponding car and means for inhibiting operation of the detector when the indicated direction of movement of the car is opposite the direction of counting of said binary counter means.

14. A control circuit as claimed in claim 11, wherein said allotting circuit includes express service control means comprising means responsive to said scanning signal generator means for applying the output of said hall call detector means to some of said detecting means during a first period of counted numbers and to others of said detecting means during a second period of counted numbers generated by said generator means.

* * * * *